US011034492B2

(12) United States Patent
Goumas

(10) Patent No.: US 11,034,492 B2
(45) Date of Patent: Jun. 15, 2021

(54) HYGIENIC DEVICE FOR A CAN

(71) Applicant: Philippe Goumas, Paris (FR)

(72) Inventor: Philippe Goumas, Paris (FR)

( * ) Notice: Subject to any disclaimer, the term of this patent is extended or adjusted under 35 U.S.C. 154(b) by 167 days.

(21) Appl. No.: 16/093,226

(22) PCT Filed: Dec. 1, 2016

(86) PCT No.: PCT/EP2016/079498
§ 371 (c)(1),
(2) Date: Oct. 12, 2018

(87) PCT Pub. No.: WO2017/178085
PCT Pub. Date: Oct. 19, 2017

(65) Prior Publication Data

US 2019/0161256 A1 May 30, 2019

(30) Foreign Application Priority Data

Apr. 14, 2016 (FR) ..... 1653316

(51) Int. Cl.
*B65D 51/18* (2006.01)
*B65D 17/00* (2006.01)

(52) U.S. Cl.
CPC ..... *B65D 51/185* (2013.01); *B65D 17/02* (2013.01); *B65D 2517/0098* (2013.01)

(58) Field of Classification Search
CPC .... B65D 2517/0082; B65D 2517/0098; B65D 17/02; B65D 51/18; B65D 51/185; B23K 26/324
See application file for complete search history.

(56) References Cited

U.S. PATENT DOCUMENTS 4,708,257 A * 11/1987 Deline ..... B65D 51/20 220/257.2
5,647,497 A * 7/1997 Labbe ..... B65D 51/185 220/257.2
6,378,718 B1 * 4/2002 Maggi ..... B65D 51/20 220/257.1

(Continued)

FOREIGN PATENT DOCUMENTS

WO 1999037546 A1 7/1999
WO 2007043890 A2 4/2007
WO 2012087168 A1 6/2012

OTHER PUBLICATIONS

International Search Report dated Jan. 26, 2017 for Parent PCT Appl. No. PCT/EP2016/079498.

*Primary Examiner* — Andrew T Kirsch
(74) *Attorney, Agent, or Firm* — James E. Walton

(57) ABSTRACT

The invention relates to a hygienic protective membrane (2) for a drink can (12) provided with a lid (14) with a circular edge (16) and a ring suitable to form an orifice in a detachable zone of said lid, the membrane (2) comprising a first and a second film (6) superimposed and adhered to each other, said membrane (2) being configured to be disposed with the first film adhered to the lid (14), the second film (6) being separable from the first in order to give access to the orifice of the lid. The membrane has a central portion (8) generally circular suitable to cover the lid (14) and a lateral portion (10) forming a strip from the circular portion and adapted to cover the edge of said lid.

10 Claims, 2 Drawing Sheets

(56) References Cited

U.S. PATENT DOCUMENTS

| | | | | |
|---|---|---|---|---|
| 6,899,244 | B2 * | 5/2005 | Takayama | B65D 17/00 220/257.2 |
| 2002/0062922 | A1 | 5/2002 | John | |
| 2009/0047501 | A1 * | 2/2009 | Yaoi | B32B 15/08 428/327 |

* cited by examiner

HYGIENIC DEVICE FOR A CAN

TECHNICAL FIELD

The invention relates to a hygienic protective membrane for a drink can.

BACKGROUND OF THE INVENTION

Published patent document WO 99/37546 discloses a hygienic protective device for a drink can intended to be placed on the lid of a can. The device comprises a lower film portion covering a part of the can lid around the ring and the opening and an upper film portion superimposed and adhered to the lower portion. The two portions are interconnected by a hinge and the upper portion is intended to be separated from the lower portion by pivoting around the hinge to the can rim. The lower portion remains attached to the can lid thus forming a bearing surface of the upper lip of a consumer and the upper portion a bearing surface of the lower lip. However, the device does not fully protect the can lid. Thus, when a consumer drinks directly from the can or pours the drink into a container, the drink may come into contact with the unhygienic area and become contaminated. In addition, the hygienic surface formed by the upper portion does not fit the shape of the can rim which can favour the flow of drink on either side of the rim formed by the upper portion. The upper portion that tilts must also be maintained by the consumer when the consumer drinks directly from the can or pours the liquid into a container.

Published patent document WO 2012/087168 discloses a hygienic protective membrane for covering the upper face and the rims of a drink can. This membrane is composed of an aluminium film and a PET film interconnected and non-separable. This membrane does not comprise an easy opening to access the orifice of the can and requires that the lid and the rims of the can be perfectly hygienic before the membrane is fixed.

Published patent document WO 2007/043890 A2 discloses a hygienic protective membrane according to the preamble of claim 1.

SUMMARY OF THE INVENTION

Technical Problem to be Solved

The invention aims to provide a hygienic protective membrane for drink can overcoming at least one drawback of the prior art, more specifically the prior art mentioned above. More particularly, the invention aims to provide a hygienic protective membrane for drink can which allows to drink directly from the can or to pour the drink in a glass without any contamination. The invention also aims to provide a simple and economical solution.

Technical Solution

The invention relates to a hygienic protective membrane for a drink can provided with a lid with a circular edge and a ring suitable to form an orifice in a detachable zone of said lid, the membrane comprising a first and a second film superimposed and adhered to each other, said membrane being configured to be disposed with the first film adhered to the lid, the second film being separable from the first in order to provide access to the orifice of the lid; remarkable in that the membrane has a central portion generally circular intended to cover the lid and a lateral portion forming a strip from the circular portion and suitable to cover the edge of said lid.

According to an advantageous embodiment of the invention, the lateral portion comprises a distal end with a zone where the first and second films are not adhered to each other so that the second film forms a zipper tab in order to separate the two films.

According to an advantageous embodiment of the invention, the zone where the first and second films are not adhered to each other extends over several square millimeters, preferably at least 50 $mm^2$, more preferably at least 100 $mm^2$.

According to an advantageous embodiment of the invention, the lateral portion extends over 20 mm from the central portion, so as to cover an upper portion of a vertical side of the can, adjacent to the lid.

According to an advantageous embodiment of the invention, each of the first and second films has a thickness of less than 1 mm, preferably comprised between 0.01 and 0.75 mm, more preferably comprised between 0.05 and 0.5 mm.

According to an advantageous embodiment of the invention, the first and second films are attached to each other at one end of said membrane opposite to the lateral portion, so as to form a hinge during the separation of the second film.

According to an advantageous embodiment of the invention, the first film comprises an orifice configured to fit the contours of the ring of the can.

According to an advantageous embodiment of the invention, the first film comprises a line of weakening or precut corresponding to the detachable zone of the lid forming the orifice.

The invention also relates to a drink can comprising a lid with a circular edge and a ring suitable to form an orifice in a detachable zone of said lid and a protective membrane disposed on the lid, remarkable in that the membrane is according to the invention.

According to an advantageous embodiment of the invention, the detachable zone of the lid remains covered by the first film after formation of the orifice.

Advantages of the Invention

The measures of the invention are interesting in that the membrane ensures a hygienic surface of the can on the entire lid and on the rim of the can, where the consumer will put his lips. The presence of the two films makes it possible to isolate the lid and the rim of the can from an unhygienic environment and allows direct contact with the can without any risk of contamination. The membrane fits the shape of the can rim which allows the consumer to easily drink from the can or to easily pour its content into a container avoiding any contamination.

DESCRIPTION OF EMBODIMENTS

FIGS. 1 to 4 are not at the same scale and are given only as an illustration and not limitative of the invention.

Figure 1:
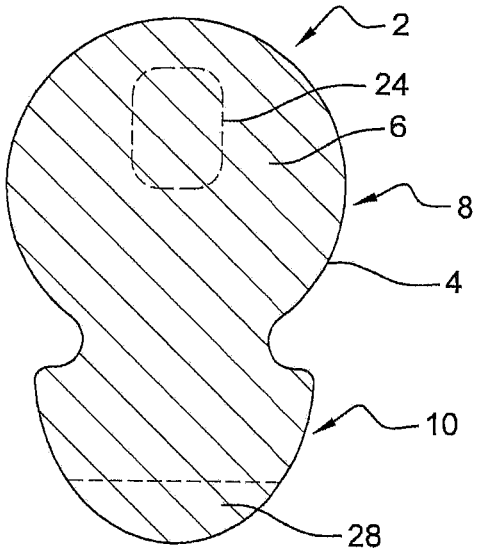
FIG. 1 is a representation of the membrane seen from above.

FIG. 1 shows the membrane 2 according to the invention. The membrane 2 comprises a first film 4 and a second film 6 superimposed and adhered to each other, only the second film 6 is visible here. The membrane 2 is configured to be disposed on a drink can lid generally made of metal, with the first film adhered to the lid of the can and the second film 6 separable from the first in order to give access to the orifice of the can. The membrane 2 comprises a central portion 8 generally circular intended to cover the lid of the can and a lateral portion 10 forming a strip from the central portion and which is capable of covering the edge of the can lid.

The membrane 2 is made of a material ensuring the integrity of the membrane facing the storage conditions of cans such as moisture or heat. The membrane 2 is preferably made of a flexible material, waterproof, resistant to tearing and more preferably recyclable. The membrane 2 may also be formed of a material on which it can be printed or written. In order to guarantee the hygiene of the membrane, the two films must adhere to each other in a sealed manner. The two films 4; 6 can be adhered to each other by heating for example. The two films are preferably adhered to one other along their edges. The lateral portion 10 comprises a distal end with a zone 28 where the first and second films 4 and 6 are not adhered to one other so that the second film 6 forms a zipper tab in order to separate the two films. The zone 28 extends over several square millimeters, preferably at least 50 $mm^2$, more preferably at least 100 $mm^2$. The first and second films 4 and 6 are attached to each other at one end of said membrane 2 opposite to the lateral portion 10, so as to form a hinge during the separation of the second film 6.

The first film 4 comprises an orifice 24, here shown in dotted line, with a size that allows the passage of the can ring adapted to form an orifice, said orifice 24 being configured to fit the contours of said ring. The first and second films 4 and 6 of the membrane 2 each have a thickness of less than 1 mm, preferably between 0.01 and 0.75 mm, more preferably between 0.05 and 0.5 mm, which allows the membrane to fit the shape of the can.

Figure 2:
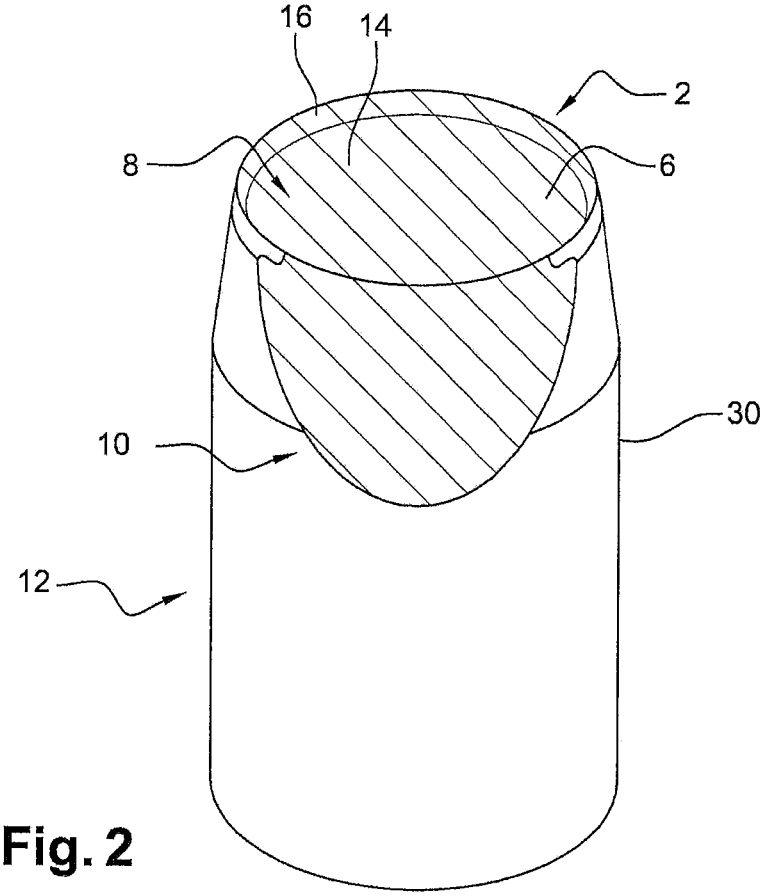
FIG. 2 represents the membrane according to the invention fixed on a can and in a closed configuration.

FIG. 2 shows the membrane 2 according to the invention in a closed configuration and fixed on a can 12 provided with a lid 14 with a circular edge 16. The membrane 2 is fixed to the lid 14 of the can with the first film adhered to the lid 14 and the second film 6 being separable from the first in order to give access to the orifice (not visible) of the lid 14. The first film can be adhered to the lid 14 by means of adhesive material for example. The central portion 8 of the membrane covers the entire lid of the can 14 and the lateral portion 10 extends from the central portion over more than 20 mm so as to cover an upper portion of a vertical side 30 of the can 12 adjacent to the lid 14. More particularly the lateral portion 10 extends over the upper part of a vertical side 30 of the can adjacent to the orifice of the lid, which corresponds to the place where the consumer will put his lips. The lid and the can ring must be sterile before attaching the membrane to the can.

Figure 3:
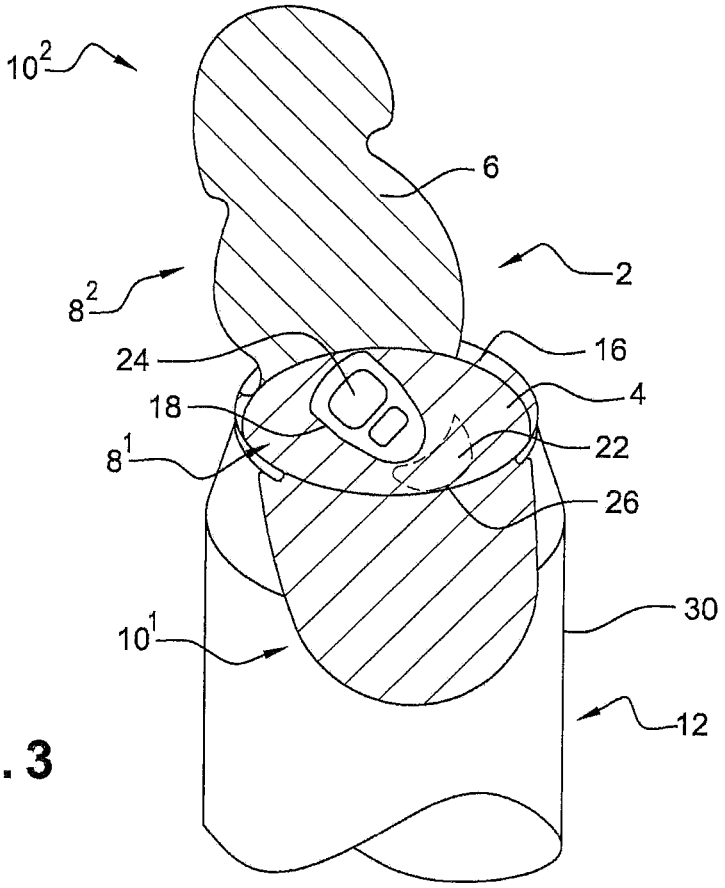
FIG. 3 shows the membrane fixed on the can and in an open configuration.

FIG. 3 shows the membrane 2 fixed on the lid of the can 12 in an open configuration. The second film 6 is almost completely separated from the first film 4 and we now have access to the ring 18 and to a detachable zone 22 of the lid forming the lid orifice. The first film 4 comprises a line of weakening or precut 26 corresponding to the detachable zone 22 of the lid forming the orifice, so as to facilitate the cutting of the first film when opening the can. The references $\mathbf{8}^1$ and $\mathbf{10}^1$ respectively correspond to the central portion and to the lateral portion of the first film 4 and the references $\mathbf{8}^2$ and $\mathbf{10}^2$ respectively correspond to the central portion and to the lateral portion of the second film 6.

Figure 4:
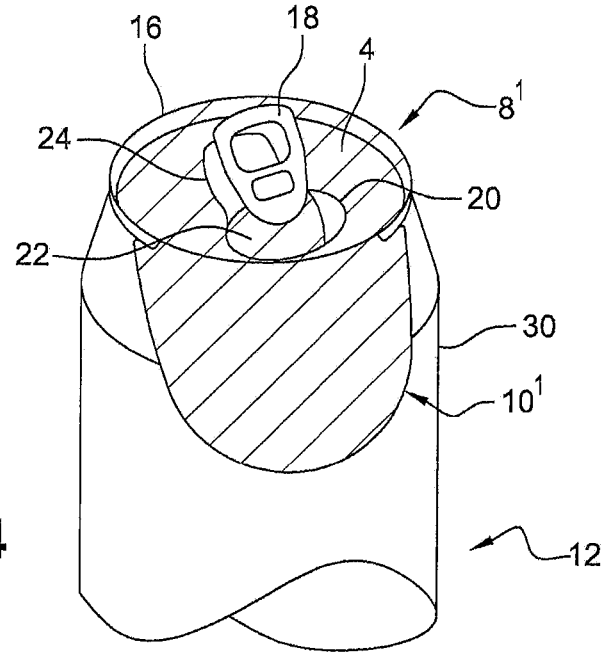
FIG. 4 shows the membrane fixed on the can without the second film, the can is here in open configuration.

FIG. 4 shows the membrane fixed on the lid of the can 12, the can being open here. The second film has been completely separated from the first film 4 in order to access the detachable zone 22 of the lid forming the orifice 20. The first film 4 remains adhered to the lid. The ring 18 of the can was tilted so as to detach the zone 22 from the lid in order to form the orifice 20 of the can. After formation of the orifice 20 of the can, the detachable zone 22 of the lid remains covered and protected by the first film 4 thanks to the line of precut or weakening which facilitates its cutting during the opening of the can. This then prevents the liquid contained in the can to be in direct contact with the detachable zone 22 since said zone remains protected by the first film when the can is opened.

The invention claimed is:

1. Hygienic protective membrane for a drink can having a lid with a circular edge and a ring suitable to form an orifice in a detachable zone of said lid, the membrane comprising:

a first and a second film superimposed and adhered to each other, said membrane being configured to be disposed with the first film adhered to the lid, the second film being separable from the first film in order to provide access to the orifice of the lid;

a lateral portion configured to cover the edge and an upper portion of a vertical side of said lid while the first and second films are adhered to each other; and a generally circular central portion configured to cover the lid, the lateral portion forming a strip extending from the circular portion onto the edge and the upper portion of the vertical side.

2. The membrane according to claim 1, wherein the lateral portion comprises:

a distal end with a zone where the first film and the second film are not adhered to each other, so that the second film forms a zipper tab in order to separate the two films.

3. The membrane according to claim 2, wherein the zone where the first film and the second film are not adhered to each other extends over multiple square millimeters, including:

at least 50 $mm^2$; or at least 100 $mm^2$.

4. The membrane according to claim 1, wherein the lateral portion extends over more than 20 mm from the central portion, so as to cover an upper portion of a vertical side of the can, adjacent to the lid.

5. The membrane according to claim 1, wherein each of the first film and the second film has a thickness of:

less than 1 mm;

between 0.01 and 0.75 mm; or between 0.05 and 0.5 mm.

6. The membrane according to claim 1, wherein the first film and the second film are attached to each other at one end of said membrane opposite to the lateral portion, so as to form a hinge during the separation of the second film.

7. The membrane according to claim 1, wherein the first film comprises:

an orifice configured to fit the contours of the ring of the can.

8. The membrane according to claim 1, wherein the first film comprises:

a line of weakening or precut corresponding to the detachable zone of the lid forming the orifice.

9. A drink can, comprising:

a lid with a circular edge and a ring configured to form an orifice in a detachable zone of said lid and a protective membrane disposed on the lid;

wherein the membrane comprises:

a first and a second film superimposed and adhered to each other, said membrane being configured to be disposed with the first film adhered to the lid, the second film being separable from the first film in order to provide access to the orifice of the lid;

a lateral portion configured to cover the edge and an upper portion of a vertical side of said lid while the first and second films are adhered to each other; and a generally circular central portion configured to cover the lid, the lateral portion forming a strip extending from the circular portion onto the edge and the upper portion of the vertical side.

10. The drink can according to claim 9, wherein the detachable zone of the lid remains covered by the first film after formation of the orifice.

* * * * *